United States Patent [19]

Niinuma

[11] 4,297,541

[45] Oct. 27, 1981

[54] GANGED PUSH BUTTON SWITCH HAVING MEANS PREVENTING SIMULTANEOUS ACTUATION OF TWO PUSH BUTTONS

[75] Inventor: Akira Niinuma, Furukawa, Japan

[73] Assignee: Alps Electric Co., Ltd., Tokyo, Japan

[21] Appl. No.: 84,533

[22] Filed: Oct. 15, 1979

[30] Foreign Application Priority Data

Oct. 20, 1978 [JP] Japan ..... 53-144226[U]

[51] Int. Cl.[3] ..... H01H 9/20

[52] U.S. Cl. ..... 200/5 E; 200/5 EA; 200/50 C

[58] Field of Search ..... 200/5 R, 5 A, 5 B, 5 C, 200/5 D, 5 E, 5 EA, 5 EB, 5 F, 50 C

[56] References Cited

U.S. PATENT DOCUMENTS 3,544,739 12/1970 Shah ..... 200/5 E

*Primary Examiner*—J. V. Truhe

*Assistant Examiner*—Morris Ginsburg

*Attorney, Agent, or Firm*—Guy W. Shoup; Gerard F. Dunne

[57] ABSTRACT

A ganged push button switch comprises at least two modular push button switches each of which includes a push button formed with a cam surface. A plate member is arranged in a manner so as to be laterally movable between the two switches and has oblique edges adapted to abut upon the respective cam surfaces. The plate member is provided at its center with elastic engaging portions, and slots are formed in the sides of the cases of the respective switches and serve to hold the plate member slidably. The plate member is attachable to the assembly by deforming one of the elastic engaging portion and inserting it through one of the slots. After attachment, the engaging portions abut against the cases of the respective switches to prevent the plate member from coming off.

4 Claims, 11 Drawing Figures

GANGED PUSH BUTTON SWITCH HAVING MEANS PREVENTING SIMULTANEOUS ACTUATION OF TWO PUSH BUTTONS

BACKGROUND OF THE INVENTION

The present invention relates to an assembly of push button switches ganged together and, more particularly, to an assembly having a plate member preventing simultaneous actuation of two of the push buttons.

Such ganged push button switch assemblies such as that described in U.S. Pat. No. 3,544,739, typically have the plate member preventing simultaneous actuation assembled internally of the switch assembly during fabrication. This normally complicates assembly and makes it quite difficult to remove or change the plate member should desired operation conditions warrant simultaneous operation.

SUMMARY OF THE INVENTION

An object of the present invention is to provide an assembly of ganged push button switches having a plate member which can be incorporated into the switch assembly quite easily.

Another object of the present invention is to provide such a switch assembly in which the plate member can be independently detached from a switch block of the assembly quite easily.

Still another object of the present invention is to provide a switch block for an assembly of ganged push buttons which can easily provide structures preventing simultaneous actuation of two of the push buttons.

According to the present invention, a push button of each of the modular switches constituting a ganged switch assembly is formed with a cam surface, and a case for each switch is formed with lateral slots. After the modular switches have been ganged, a plate member which operates in cooperation with the cam surfaces of the plungers is fitted through the slots of the adjacent modular switches. The plate member is formed with elastic engaging portions, and it is freely attached into or detached from the slots by deforming the engaging portions.

DESCRIPTION OF THE PREFERRED EMBODIMENTS

Figure 1:
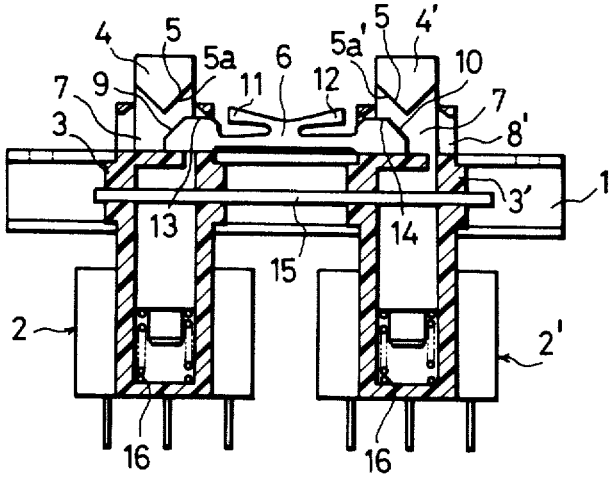
FIG. 1(A) is a sectional view of a ganged push button switch block according to the present invention.
FIG. 1(B) is a sectional view thereof wherein one of the push button is depressed.
Figure 1:
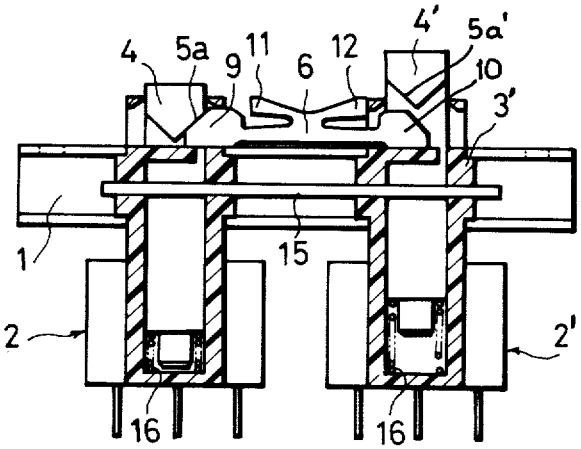
Figure 2:
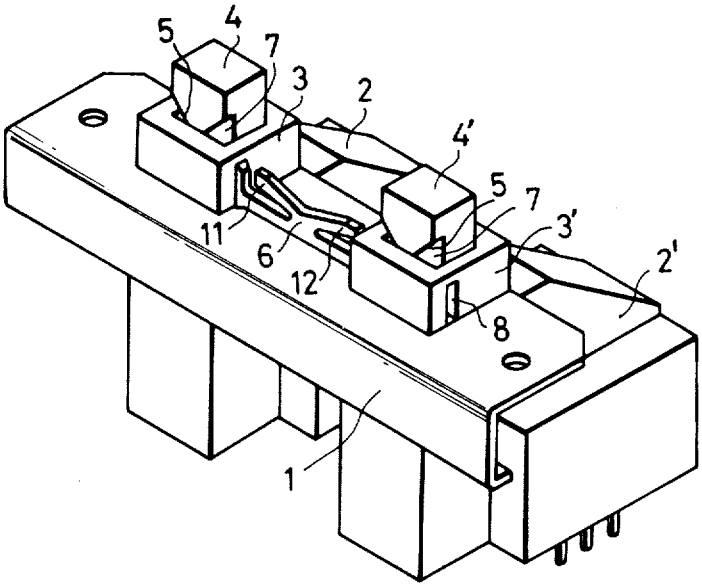
FIG. 2 is a perspective view of the ganged push button switch block of the present invention.
Figure 4:
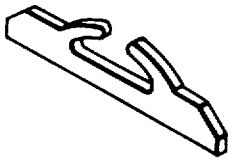
FIGS. 4(A) to 4(D) are perspective views showing various embodiments of the plate member.
Figure 4:
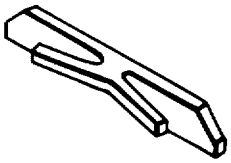
Figure 4:
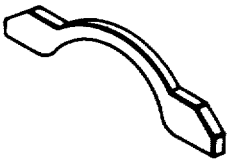
Figure 4:
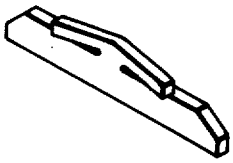

Herebelow, the present invention will be described with reference to the drawings.

Numeral 1 designates a mounting frame which is formed by punching and bending a metal sheet and on which a plurality of modular switch units 2 are mounted at substantially equal intervals. Numerals 4 and 4' designate respective push buttons of the switches 2 and 2'. The push button 4 and 4' are slidable within respective switch cases 3 and 3' preferably formed of an electrically insulating material. The upper part of a longtitudinal surface of each push button is formed with a V-shaped cam portion 5 having two slanted faces pointing to slide groove 7. The switch cases 3 and 3' are respectively provided with lateral slots 8 and 8'. Shown at 6 is a plate member molded of a synthetic resin or the like and adapted to prevent simultaneous actuation of the push button 4 and 4'. In the plate member 6, oblique edges 9 and 10 are formed at respective ends, and a pair of arms 11 and 12 extend laterally and upwardly from the central upper part. The arms 11 and 12 extend to a height above that of the upper edges 13 and 14 of the plate member 6. Numeral 15 denotes an interlocking cam plate and numeral 16 denotes springs for returning the respective push buttons, as is well known.

During operation, when only the push button 4 is depressed from the state illustrated in FIG. 1(A), the slanted face 5*a* of the cam portion 5 abuts against the oblique edge 9 of the member 6. Upon further movement of the push button 4, the switch operates and the plate member 6 is moved rightwards, and is stopped when its arm 12 abuts against the side wall of the adjacent switch case 3' as shown in FIG. 1(B). When the push button 4 is released from this depression, it is returned to the original position under the action of the return spring 16. On the other hand, when it is attempted to depress the two push buttons 4 and 4' simultaneously from the state of FIG. 1(A), both the push buttons can move until their slant faces 5*a* and 5*a'* abut against the oblique edges 9 and 10 located at the ends of the plate member 6. Upon the abutment, however, the plungers cannot move further. Accordingly, neither of the switches can operate, and simultaneous actuation is prevented.

Figure 3A:
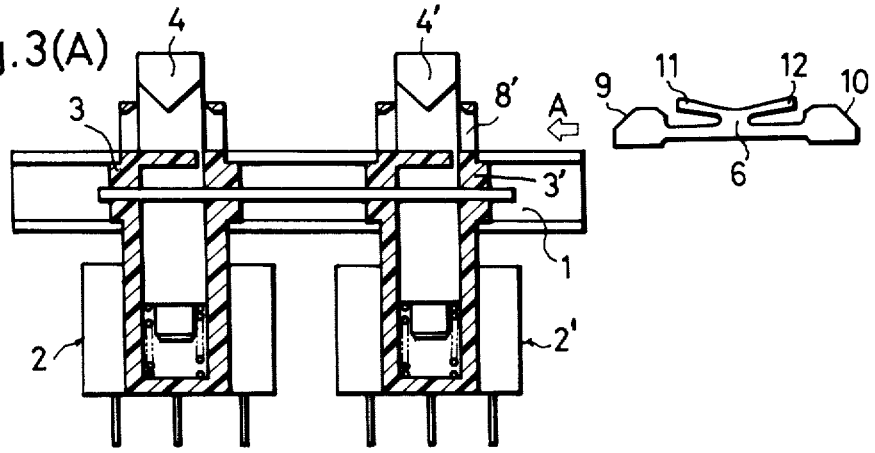
FIGS. 3(A) to 3(D) are views showing the steps of mounting the plate member for the switch block of FIGS. 1–2.
Figure 3B:
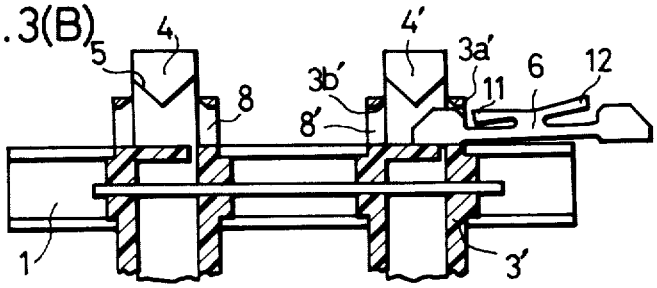
Figure 3C:
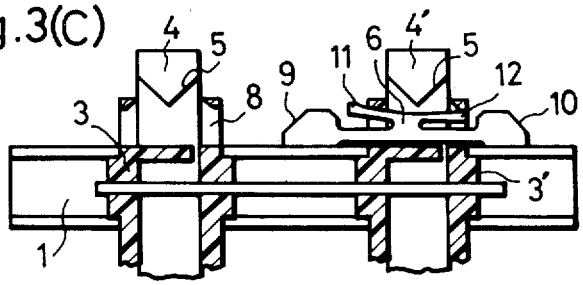
Figure 3D:
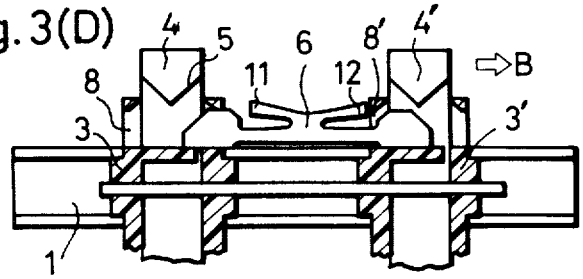

Now, the assemblage of the plate member of the switch according to the present invention will described. After the switches 2 have been mounted to the mounting frame as shown in FIG. 3(A), the plate member 6 can be slid on the mounting frame 1 in the direction of the arrow A from the exterior. The plate member 6 is inserted into the switch case 3' through the slot 8', as shown in FIG. 3(B). Since the arm 11 of the plate member 6 would otherwise abut against the side wall 3*a'* of the switch case 3', it is pushed down against its elastic force with, for example, a finger and then inserted into the switch case 3'. The plate member 6 can then be slid inside the switch case 3'. Although the arm 11 will contact the inner wall 3*b'* of the switch case 3', the inner wall 3*b'* is provided with an inclination forming a cam surface, and hence, the arm 11 moves along the inclination until the state illustrated in FIG. 3(C) is established. When the plate member 6 is further moved, the state illustrated in FIG. 3(D) is established under which the plate member 6 is mounted in its desired position. The plate member 6 once mounted does not slip out because the arms 11 and 12 extend above the slots 8 and 8' of the switch cases 3 and 3' respectively and function to prevent the plate 6 from coming off. In detaching the plate member 6 attached to the switch, the arm 12 thereof can be pushed downwards with, for example, a finger and is inserted into the slide slot 8' of the switch case 3'. Thereafter, the plate member 6 may be moved in the direction of arrow B as in the case of the mounting (refer to FIG. 3(D)).

FIGS. 4(A) to 4(D) show further embodiments of the plate member.

As set forth above, a switch according to the present invention has a plate member provided with elastically deformable engaging portions, thereby enabling the plate member to attached or detached easily from the switch proper. The structure is advantageous in simplifying the operations of assembling the switch and in permitting the plate member to be assembled or removed as may be needed for any particular operation of the switch. Further, plate member is structurally simple, and can be provided quite inexpensively.

What is claimed is:

1. A ganged push button switch assembly comprising:

a plurality of modular switches each including a push button formed with a respective cam surface, and a case formed with slots at positions adjoining said cam surface;

coupling means for coupling said plurality of modular switches into an integral switch block; and a plate member slidably held in the slots of the respective modular switches so as to be between the two adjacent modular switches in said switch block, said plate member being formed at its ends with respective cam portions cooperating with the cam surface of said modular switches and being also formed at its central part with engaging portions having an elasticity so as to permit said plate member to be attached to and detached from said slots by deforming said engaging portions.

2. A ganged push button switch according to claim 1, wherein said cam surface of each said push button being formed to be bilaterally symmetric with respect to a longitudinal axis of the respective push button.

3. A ganged push button switch according to claim 1, wherein that part of an inner wall of the slot in said each modular switch upon which the engaging portion of said plate member abuts being formed with a slanted face.

4. A ganged button switch according to claim 1, wherein said plate member is made of an elastic synthetic resin.

* * * * *